US011723466B2

(12) United States Patent
Chen et al.

(10) Patent No.: US 11,723,466 B2
(45) Date of Patent: Aug. 15, 2023

(54) EASILY ASSEMBLED CHAIR ARMREST

(71) Applicant: ATEC INTERNATIONAL TEAM CO., LTD., Luzhu Township, Taoyuan County (TW)

(72) Inventors: Te-Chun Chen, Luzhu Township, Taoyuan County (TW); Fu-Ming Chen, Luzhu Township, Taoyuan County (TW)

(73) Assignee: ATEC INIERNATIONAL TEAM CO., LTD., Luzhu Township (TW)

( * ) Notice: Subject to any disclaimer, the term of this patent is extended or adjusted under 35 U.S.C. 154(b) by 0 days.

(21) Appl. No.: 17/687,997

(22) Filed: Mar. 7, 2022

(65) Prior Publication Data

US 2022/0312966 A1 Oct. 6, 2022

(30) Foreign Application Priority Data

Mar. 30, 2021 (TW) ..... 110111599

(51) Int. Cl.
*A47C 1/03* (2006.01)

(52) U.S. Cl.
CPC ..... *A47C 1/0303* (2018.08); *A47C 1/0307* (2018.08)

(58) Field of Classification Search
CPC ..... A47C 7/54; A47C 7/541; A47C 7/624; A47C 7/68; A47B 83/02
USPC ..... 297/411.35, 411.38
See application file for complete search history.

(56) References Cited

U.S. PATENT DOCUMENTS

| | | | | |
|---|---|---|---|---|
| 5,865,124 | A * | 2/1999 | Wroe | A47C 7/70 108/157.11 |
| 10,463,155 | B2 * | 11/2019 | Hector | A47C 7/54 |
| 11,324,326 | B2 * | 5/2022 | Hsieh | A47C 1/0305 |
| 2021/0045536 | A1 * | 2/2021 | Chen | A47C 7/34 |

* cited by examiner

*Primary Examiner* — Sarah B McPartlin
(74) *Attorney, Agent, or Firm* — Muncy, Geissler, Olds & Lowe, P.C.

(57) ABSTRACT

An easily assembled chair armrest is revealed. The easily assembled chair armrest includes an armrest support, an armrest pad body, and at least one fastening member arranged between the armrest support and the armrest pad body. The fastening member includes at least one first fastening portion and at least one second fastening portion which are aligned and pressed vertically to fit and connect with each other. One of the first fastening portion and the second fastening portion is disposed on a top support surface of the armrest support while the other is arranged at a first mounting space of the armrest pad body. While being assembled to form the chair armrest, the armrest support is connected with the armrest pad body to form one part by vertical fastening of the first fastening portion and the second fastening portion of the fastening member. Thus manufacturing cost is reduced relatively.

6 Claims, 12 Drawing Sheets

EASILY ASSEMBLED CHAIR ARMREST

BACKGROUND OF THE INVENTION

The present invention relates to a chair armrest, especially to an easily assembled chair armrest.

Generally, a functional chair armrest is composed of an armrest pad and an armrest support. For manufacturers, the armrest support and the armrest pad are separated to be delivered to customers for saving space convenient packaging and/or transportation. Then clients assemble the armrest support and the armrest pad into one part by themselves. Thereby a relative decrease in manufacturing cost is achieved. However, during assembly of the armrest pad with the armrest support, additional fasteners (such as screws) or tools (such as screwdriver) are required and the design for assembly is not so user-friendly. Once the design of the assembly structure is not good enough, structural strength and/or tightness of the chair armrest assembled by the clients may be decreased and even cause a hazardous situation for the clients while in use.

Thus there is room for improvement and there is a need to provide a chair armrest which is easy to assemble without additional fasteners or tools.

SUMMARY OF THE INVENTION

Therefore, it is a primary object of the present invention to provide an easily assembled chair armrest in which an armrest support and an armrest pad body are assembled into one part by at least one first fastening portion and at least one second fastening portion of a fastening member fastened with each other vertically. The assembly is easy and additional fasteners or tools are required. Not only the issue of reduced structural strength and/or tightness of the chair armrest assembled by the users themselves can be addressed efficiently, the hazardous situation for the clients in use can also be avoided.

In order to achieve the above objects, an easily assembled chair armrest according to the present invention includes an armrest support, an armrest pad body, and at least one fastening member. A top support surface is formed on a top of the armrest support. The armrest pad body is disposed on the top support surface of the armrest support and a first mounting space with an opening facing downward is arranged at a bottom surface of the armrest pad body. The fastening member is mounted between the armrest support and the armrest pad body and composed of at least one first fastening portion and at least one second fastening portion which are aligned and pressed to fit and connect with each other vertically. One of the first fastening portion and the second fastening portion is disposed on the top support surface while the other one is arranged at the first mounting space and positions of the first fastening portion and the second fastening portion are corresponding to each other. The first fastening portion and the second fastening portion are respectively a shaft tube provided with a third fastening portion and a sleeve provided with a fourth fastening portion corresponding to the third fastening portion. The shaft tube and the sleeve are joined together by the third fastening portion fastened with the fourth fastening portion. While being assembled into the chair armrest, the armrest support and the armrest pad body are assembled into one part by the first fastening portion and the second fastening portion of the fastening member fastened with each other vertically. This leads to a relative decrease in the manufacturing cost.

Preferably, the first fastening portion is located at the top support surface of the armrest support while the second fastening portion is located in the first mounting space.

Preferably, the first fastening portion is located in the first mounting space while the second fastening portion is located at the top support surface of the armrest support.

Preferably, the armrest pad body is composed of an armrest pad and an armrest member.

Preferably, the first mounting space is located at the armrest member.

Preferably, the armrest member includes an armrest cover and an armrest base. The opening of the first mounting space is arranged at the armrest base.

Preferably, a sliding block and a sliding slot are disposed in the armrest base of the armrest member. The sliding block can be moved forward and backward in the sliding slot of the armrest base. When the armrest support and the sliding block remain still, the armrest pad body can be moved forward and backward relative to the armrest support and the sliding block for adjustment.

Preferably, the second fastening portion is located at the sliding block.

Preferably, the first fastening portion is located at the sliding block.

Preferably, the sleeve is communicating with the opening of the first mounting space and the fourth fastening portion of the sleeve is located at an inner circular surface inside the sleeve. The sleeve further includes a packing member which is mounted to the sliding block and located above the sleeve. The packing member includes at least two packing pieces which are claw-shaped and spaced apart circularly. The third fastening portion of the sleeve is formed on a top of the sleeve. While being assembled into the chair armrest, the third fastening portion of the sleeve is pressed by compressive force of the packing pieces of the packing member and forced to lock into the fourth fastening portion.

Preferably, the fourth fastening portion is a locking groove mounted to the inner circular surface, an insertion hole located at the inner circular surface, or a distal-end surface of the inner circular surface.

DETAILED DESCRIPTION OF THE PREFERRED EMBODIMENTS

Generally, a chair armrest is fastened and fixed on a right side and a left side of a chair from sitters' (users') view. The lengthwise (forward and backward) direction or widthwise (from side to side) direction hereafter are viewed from the sitter.

Refer to FIG. 1-3, FIG. 7, and FIG. 9, an easily assembled chair armrest 1 according to the present invention includes an armrest support 10, an armrest pad body 20, and at least one fastening member 30.

Figure 1:
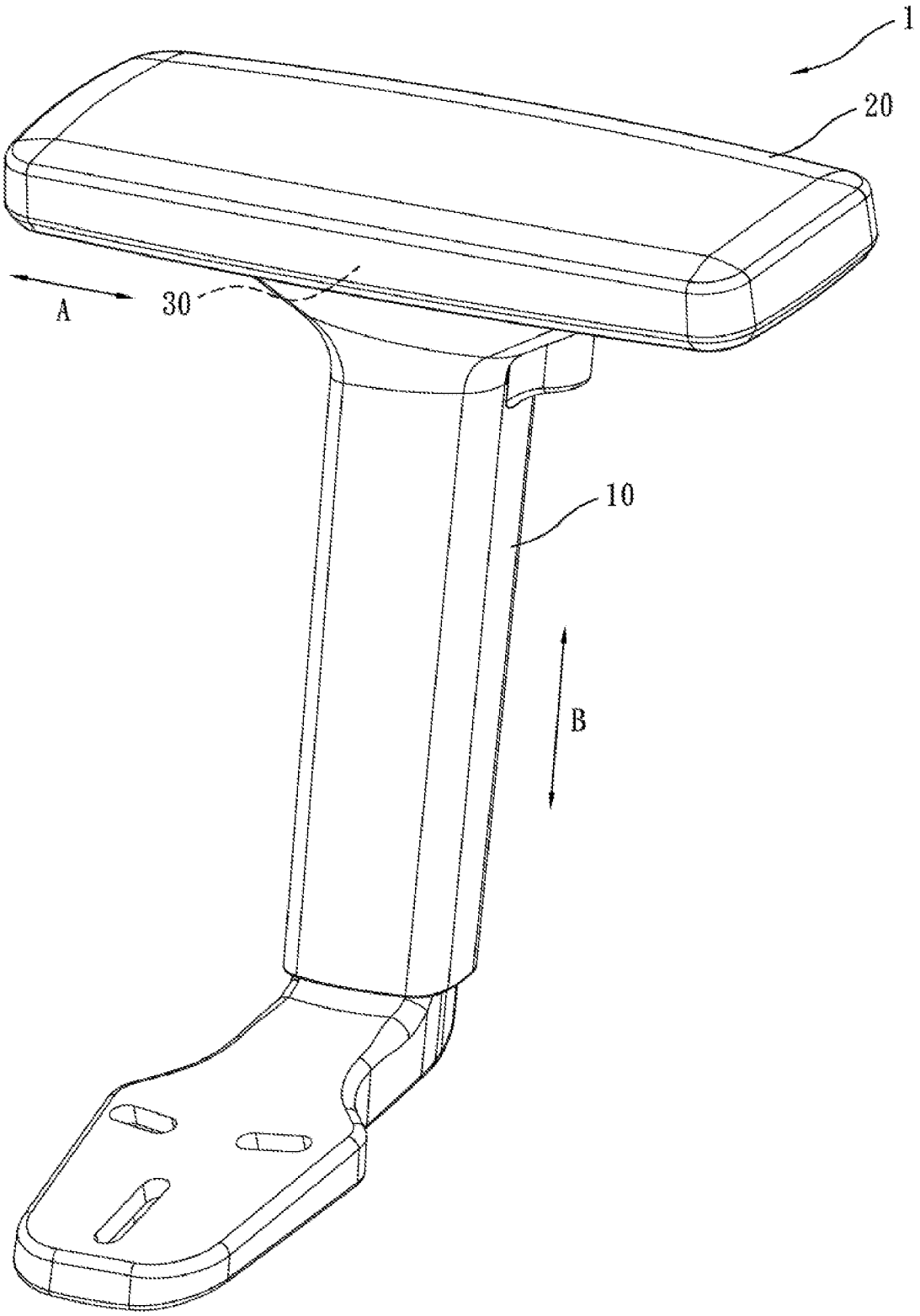
FIG. 1 is a perspective view of an embodiment according to the present invention.
Figure 2:
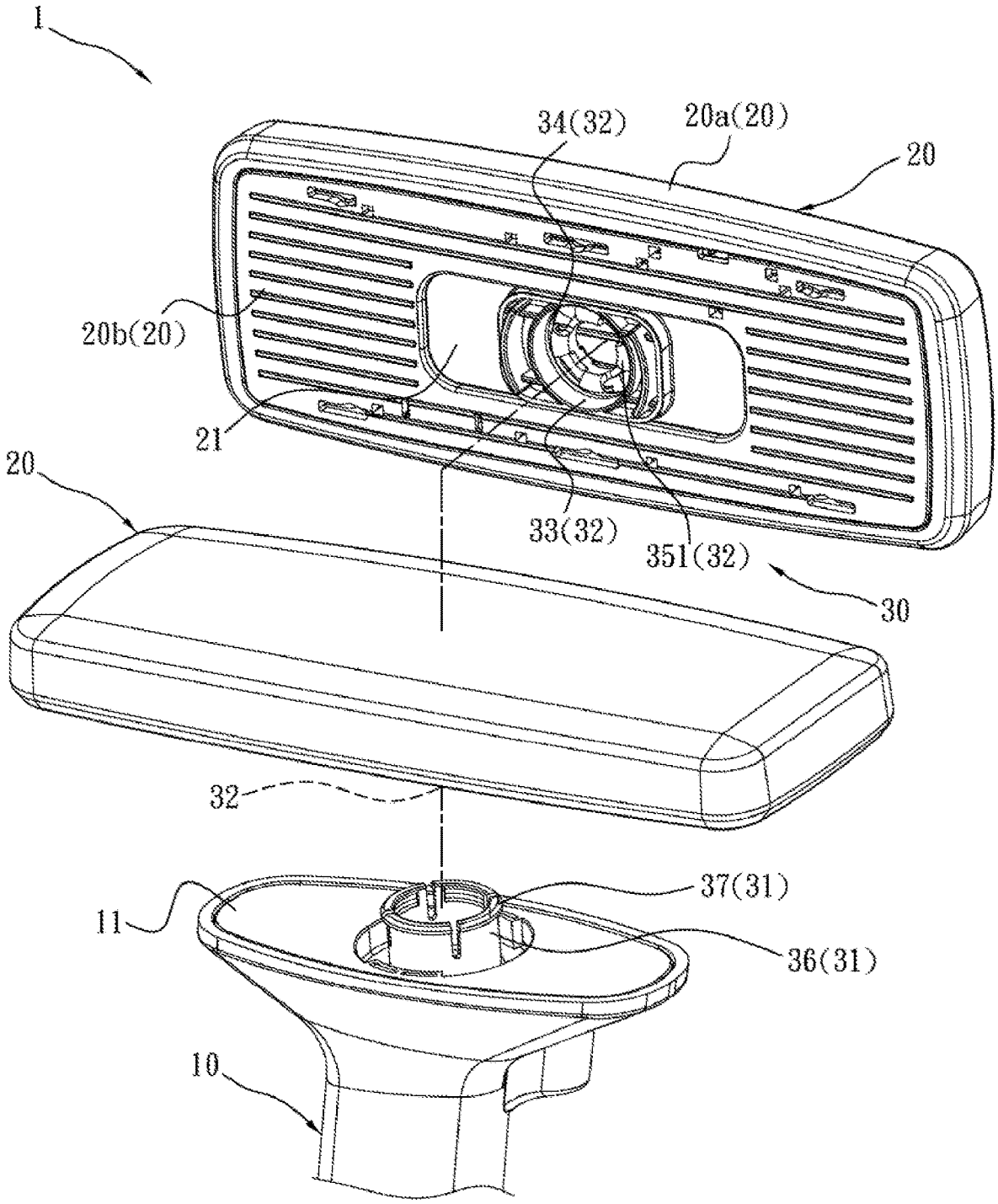
FIG. 2 is a partial exploded view of the embodiment in FIG. 1 according to the present invention.
Figure 11:
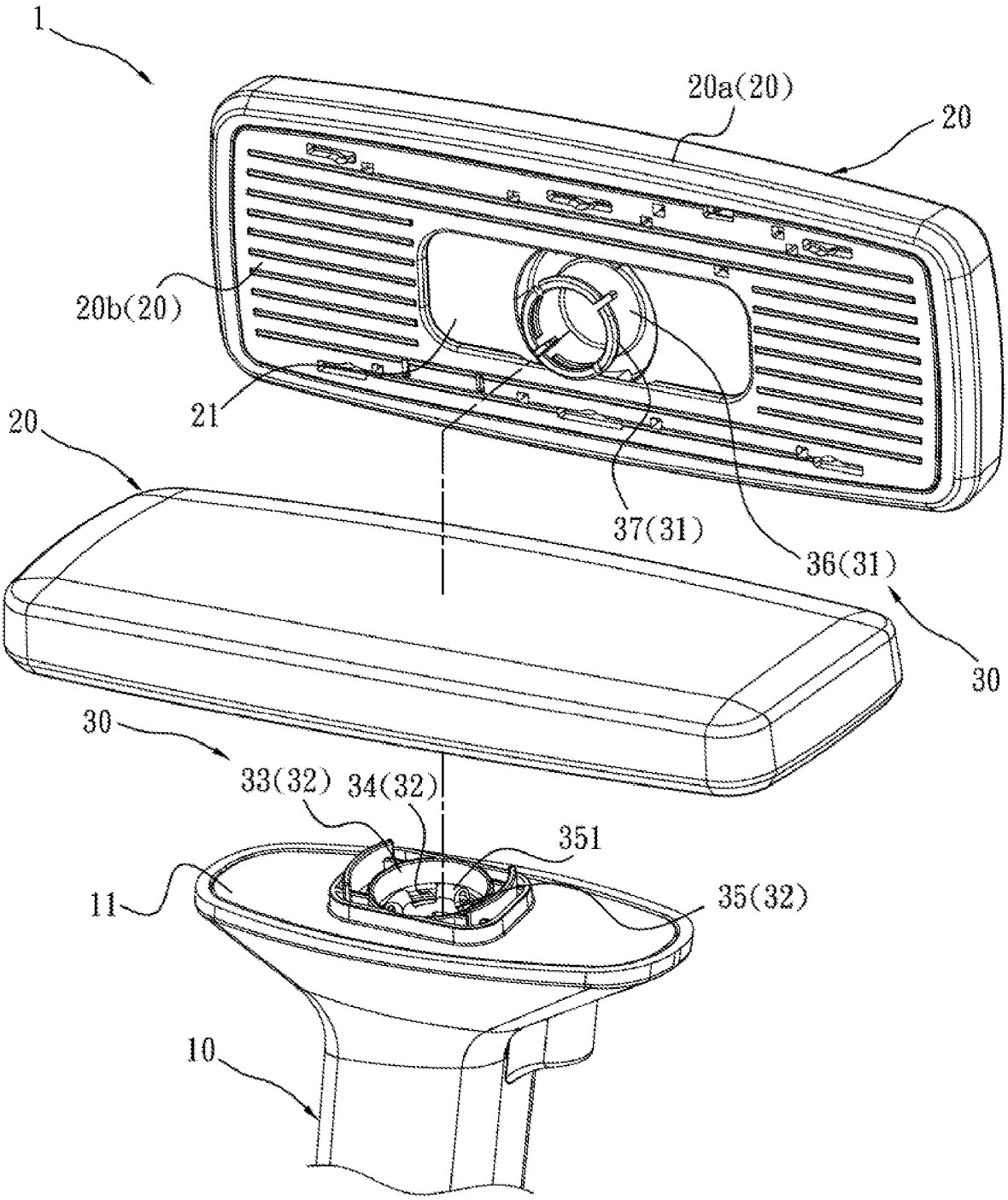
FIG. 11 is a partial exploded view of another embodiment according to the present invention.

Refer to FIG. 2 and FIG. 11, a top support surface 11 is formed on a top of the armrest support 10 which is able to be adjusted vertically, as the arrow B in FIG. 1 indicates, but not limited.

Figure 3:
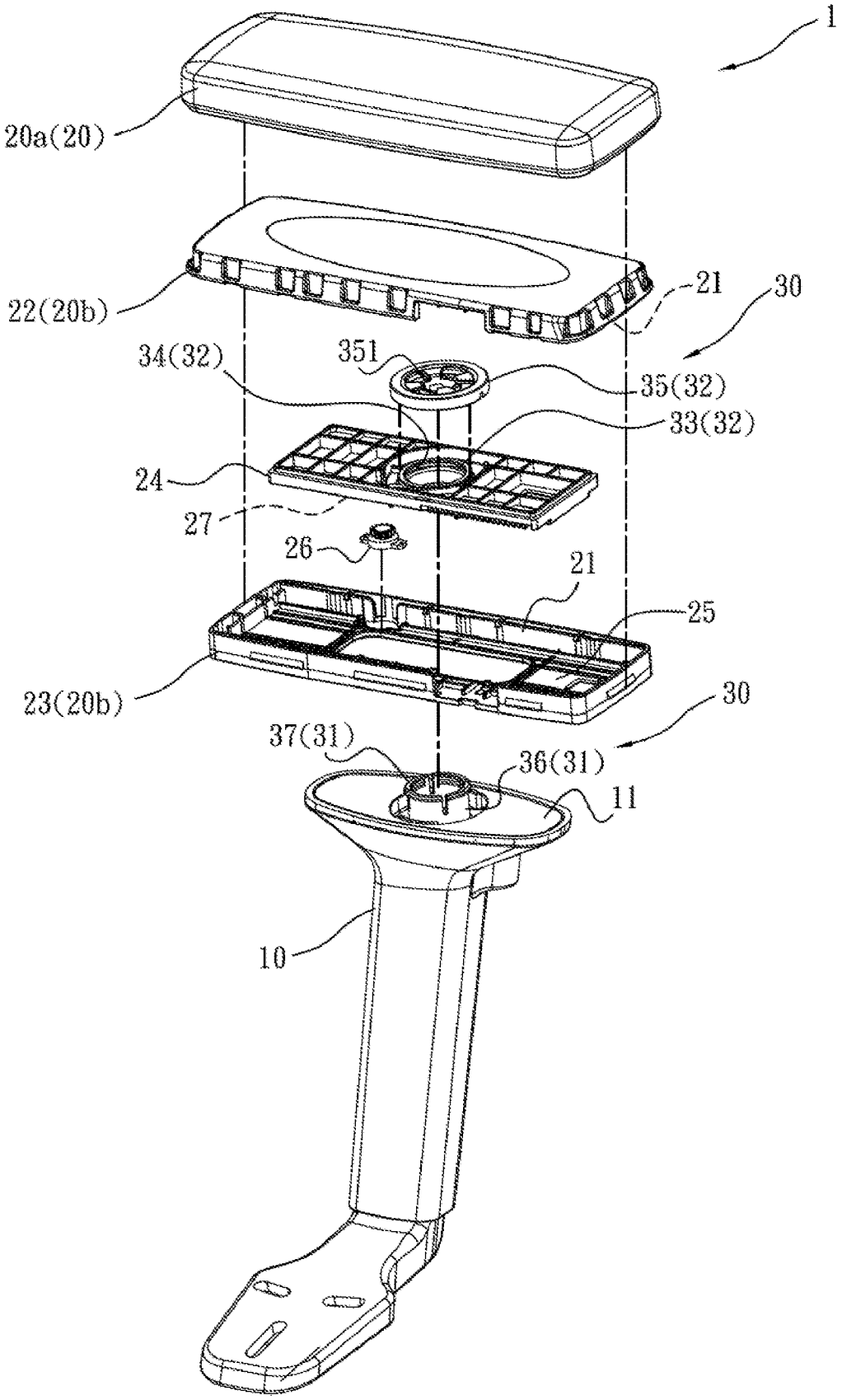
FIG. 3 is an exploded view of the embodiment in FIG. 1 according to the present invention.

As shown in FIG. 2 and FIG. 11, the armrest pad body 20 is disposed on the top support surface 11 of the armrest support 10 and a first mounting space 21 with an opening facing downward is arranged at a bottom surface of the armrest pad body 20. The armrest pad body 20 is composed of, but not limited to, an armrest pad 20*a* and an armrest member 20*b* which includes an armrest cover 22 and an armrest base 23, as shown in FIG. 3. The first mounting space 21 is located on, but not limited to, the armrest member 20*b* as shown in FIG. 2 and FIG. 11. Refer to FIG. 3, the opening of the first mounting space 21 is arranged at the armrest base 23.

Figure 12:
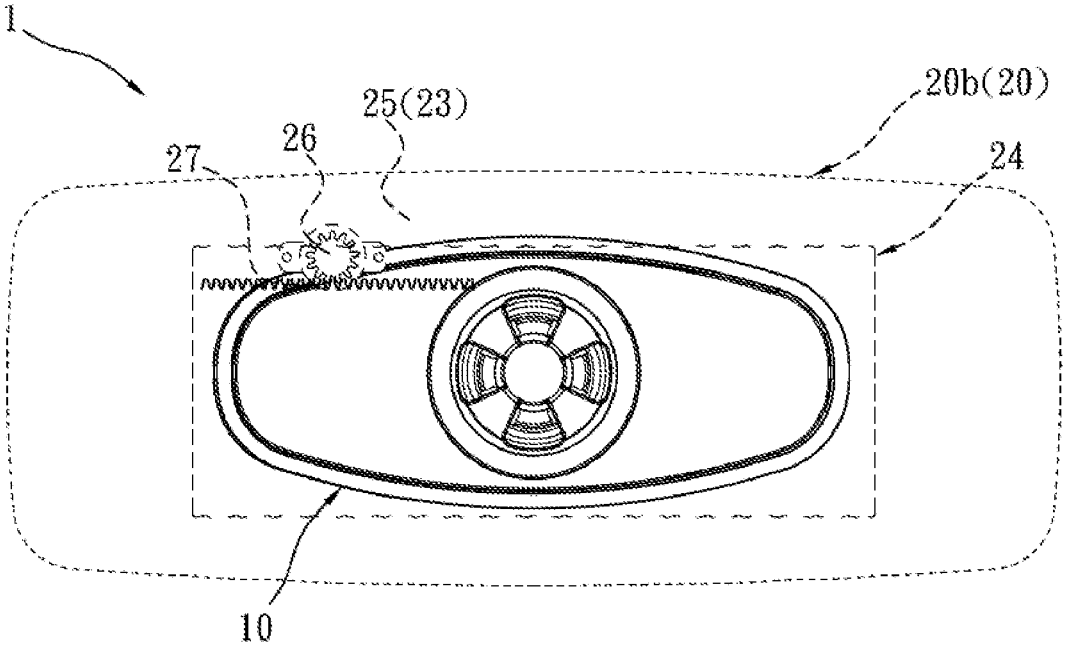
FIG. 12 is a top view of the embodiment in FIG. 1 according to the present invention.
Figure 13:
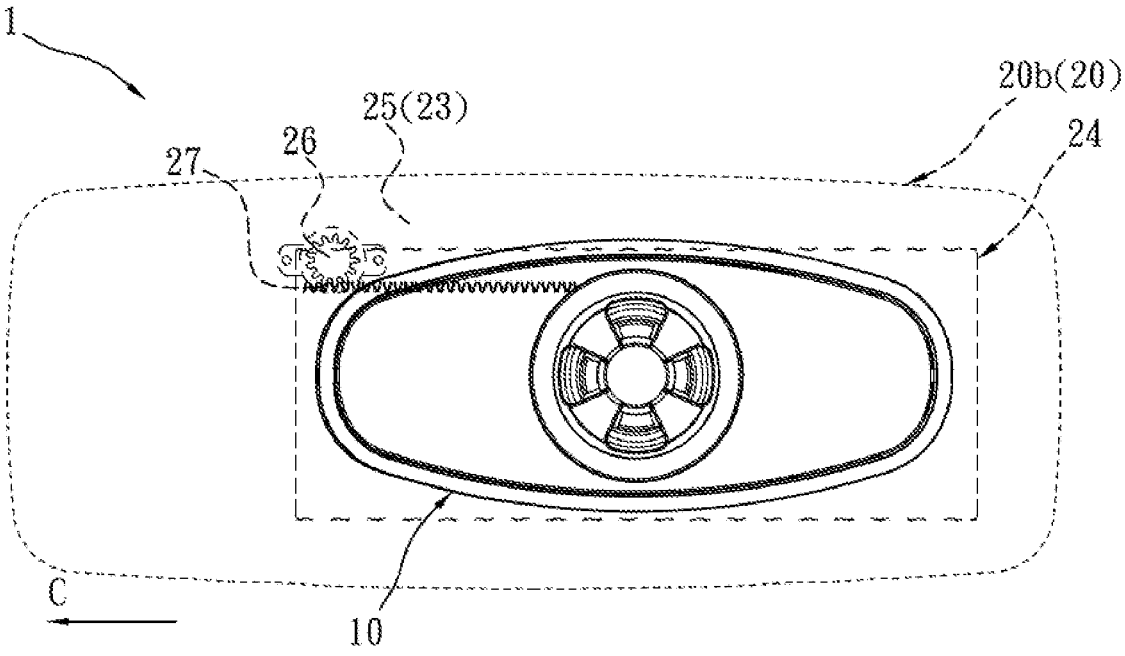
FIG. 13 is a schematic drawing showing an armrest pad body moved forward and backward relative to an armrest support and a sliding block of the embodiment in FIG. 12 according to the present invention.

Refer to FIG. 12 and FIG. 13, a sliding block 24 and a sliding slot 25 are disposed in the armrest base 23 of the armrest member 20*b*. The sliding block 24 can be moved lengthwise (forward and backward) in the sliding slot 25 of the armrest base 23, as the arrow A in FIG. 1 and the arrow C in FIG. 13 indicate. The design gives users more comfort.

Figure 8:
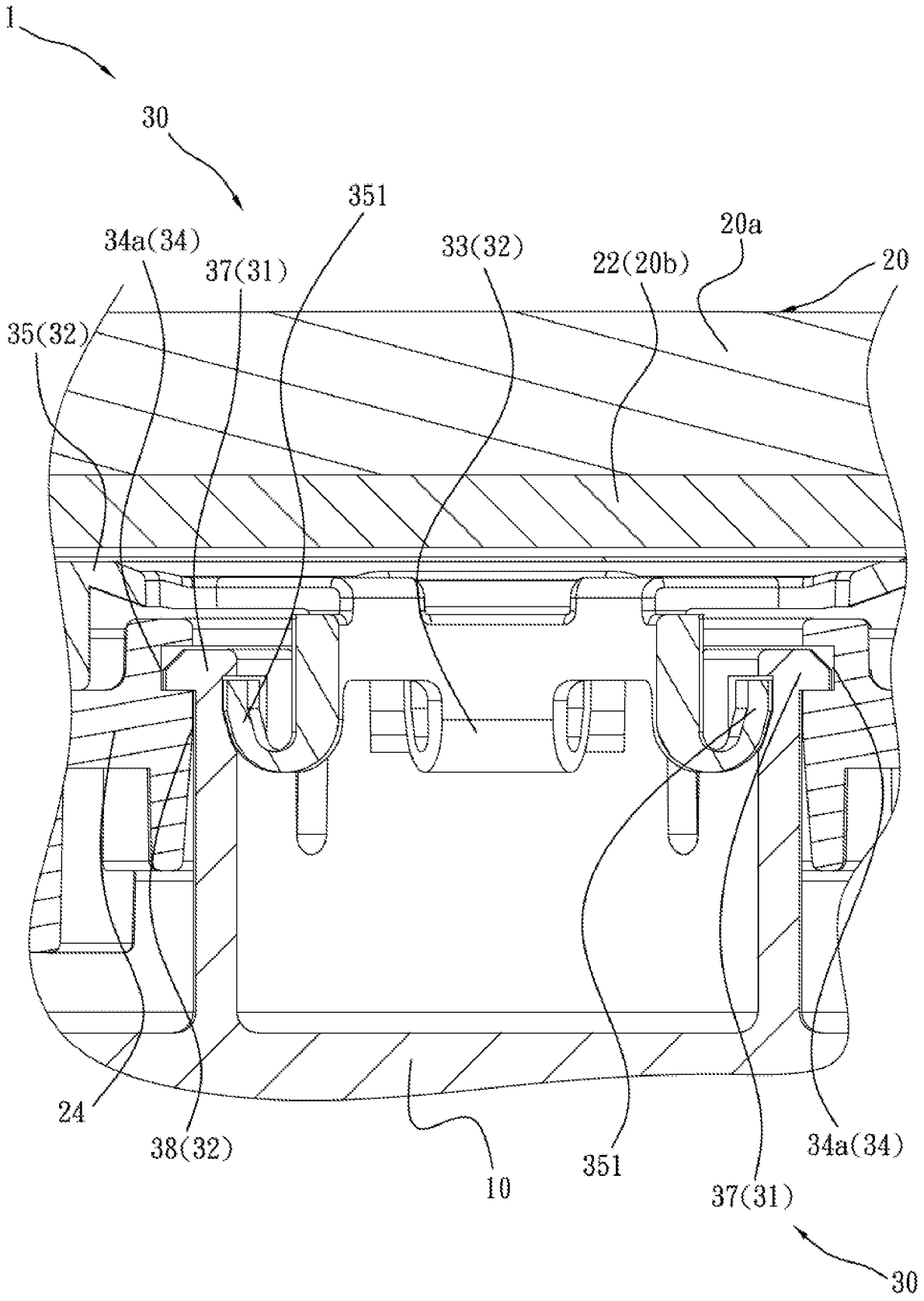
FIG. 8 is a partial enlarged view of the embodiment (in which a fourth fastening portion is a locking groove mounted to an inner circular surface) in FIG. 7 according to the present invention.
Figure 9:
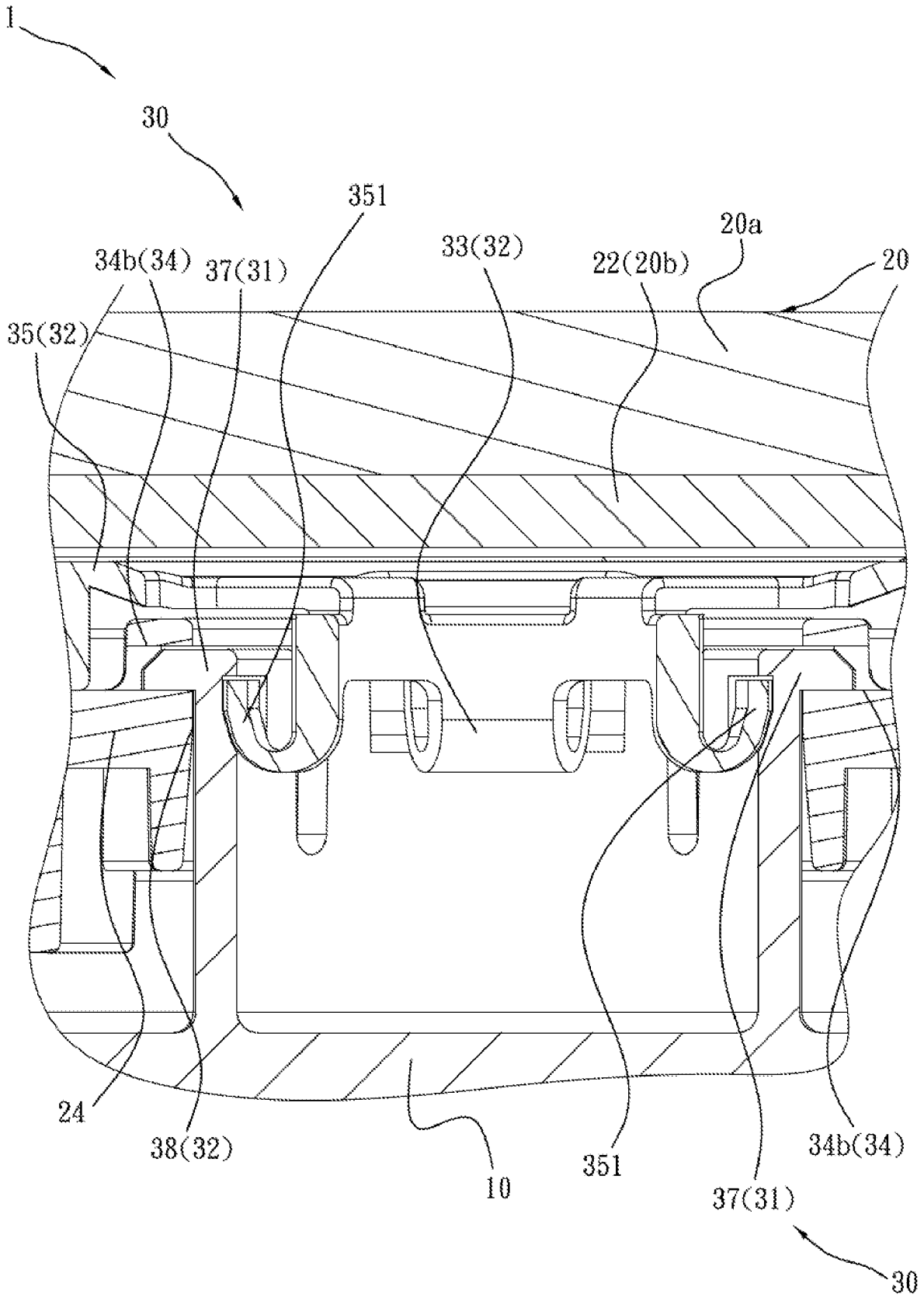
FIG. 9 is a partial enlarged view of the embodiment (in which a fourth fastening portion is an insertion hole located at the inner circular surface) in FIG. 7 according to the present invention.
Figure 10:
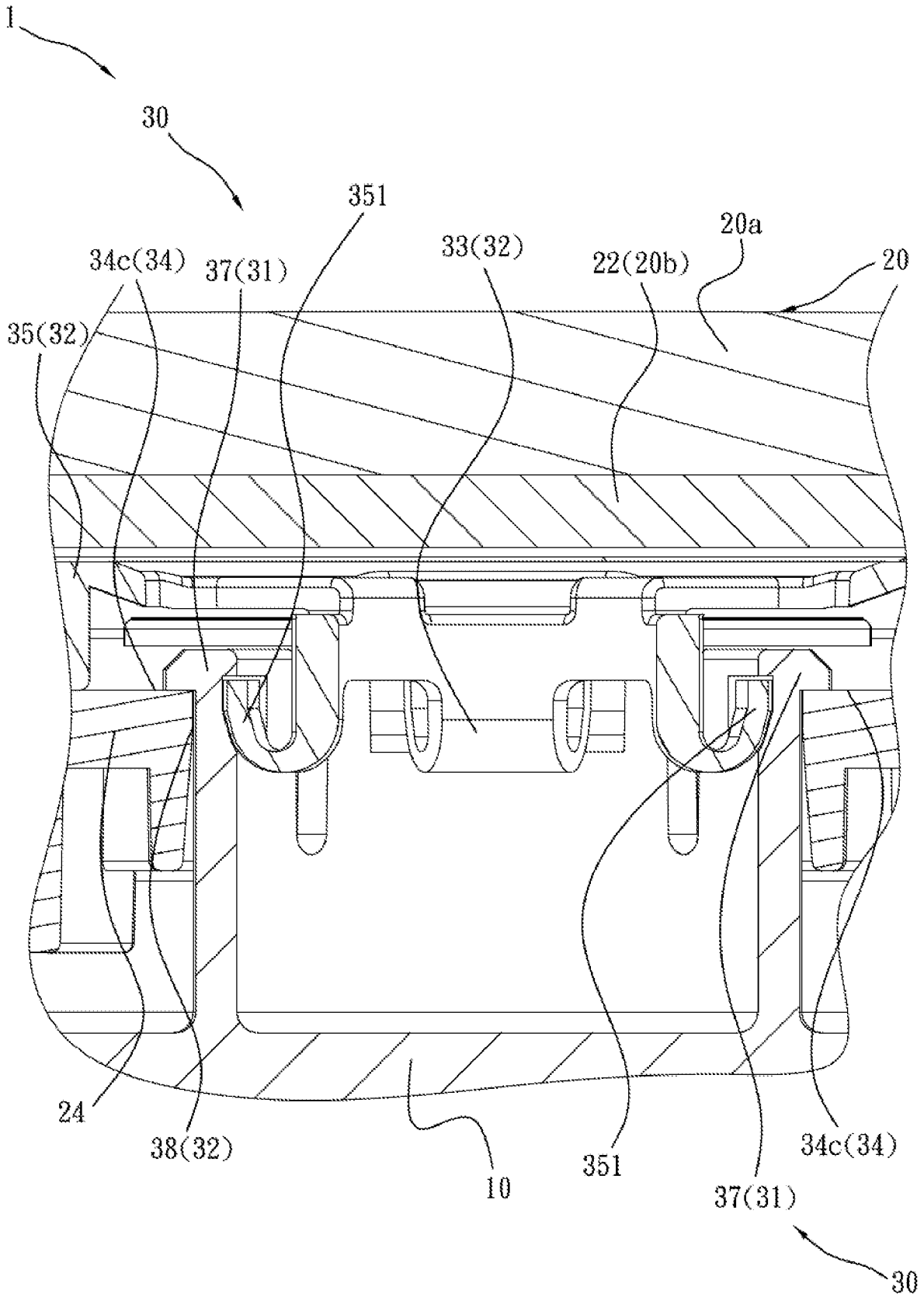
FIG. 10 is a partial enlarged view of the embodiment (in which a fourth fastening portion is a distal-end surface of the inner circular surface) in FIG. 7 according to the present invention.

The fastening member 30 is mounted between the armrest support 10 and the armrest pad body 20 and composed of at least one first fastening portion 31 and at least one second fastening portion 32 which are aligned and pressed to fit and connect with each other vertically. One of the first fastening portion 31 and the second fastening portion 32 is disposed on the top support surface 11 while the other one is arranged at the first mounting space 21 and positions of the first fastening portion 31 and the second fastening portion 32 are corresponding to each other. The first fastening portion 31 and the second fastening portion 32 are respectively a shaft tube 36 provided with a third fastening portion 37 and a sleeve 33 provided with a fourth fastening portion 34 corresponding to the third fastening portion 37. The shaft tube 36 and the sleeve 33 are affixed together by the third fastening portion 37 fastened with the fourth fastening portion 34, as shown in FIG. 8-10.

Figure 7:
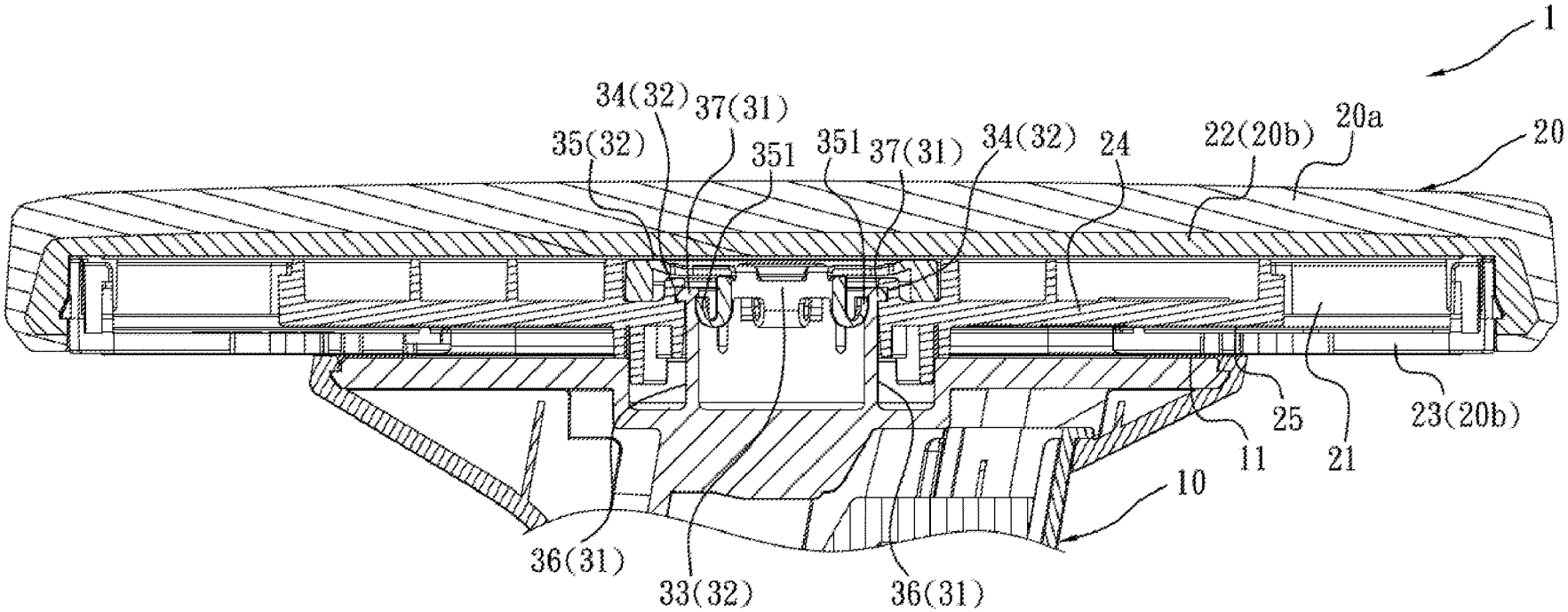
FIG. 7 is a side sectional view of an armrest pad body and an armrest support of an embodiment according to the present invention.

While being assembled into the chair armrest 1, the armrest support 10 and the armrest pad body 20 are assembled into one part by the first fastening portion 31 and the second fastening portion 32 of the fastening member 30 fastened with each other vertically. As shown in FIG. 7, the top support surface 11 of the armrest support 10 and the bottom surface of the armrest pad body 20 are closely attached to each other, without reducing structural strength and/or tightness of the chair armrest 1.

When the armrest support 10 and the sliding block 24 stay still, the armrest pad body 20 can be moved forward and backward (in the lengthwise direction) relative to the armrest support 10 and the sliding block 24 for adjustment, as the arrow A in FIG. 1 and the arrow C in FIG. 13 indicate in order to make users feel more comfortable.

In the embodiment shown in FIG. 1-10, the first fastening portion 31 is located at (but not limited to) the top support surface 11 of the armrest support 10 while the second fastening portion 32 is located in (but not limited to) the first mounting space 21. As to another embodiment shown in FIG. 1 and FIG. 11, the first fastening portion 31 is located in (but not limited to) the first mounting space 21 while the second fastening portion 32 is located at (but not limited to) the top support surface 11 of the armrest support 10. The components with the same numbers of the above two embodiments represent the same components. For example, both the above two embodiments have the armrest support 10, the armrest pad body 20, and the fastening member 30. The difference between the two embodiments is in the positions of the first fastening portion 31 and the second fastening portion 32. In one of the embodiments, the first fastening portion 31 is located at the top support surface 11 of the armrest support 10 while it's located at the first mounting space 21 in the other embodiment. The second fastening portion 32 is located at the first mounting space 21 in one of the embodiments while it's located at the top support surface 11 of the armrest support 10 in the other one of the embodiments.

The rest components and structure of the above two embodiments are about the same.

Figure 4:
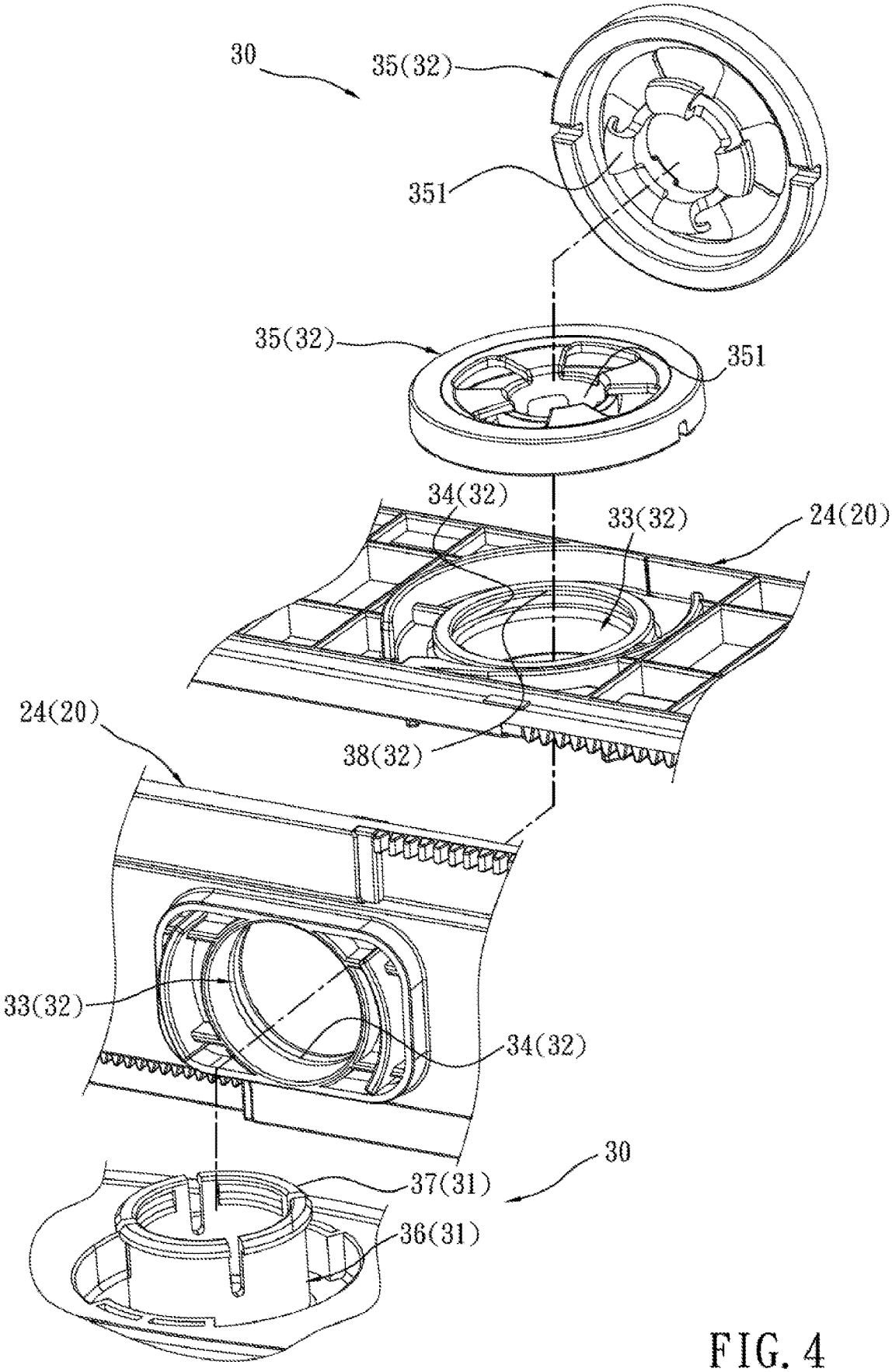
FIG. 4 is a partial enlarged view of the embodiment in FIG. 3 according to the present invention.
Figure 5:
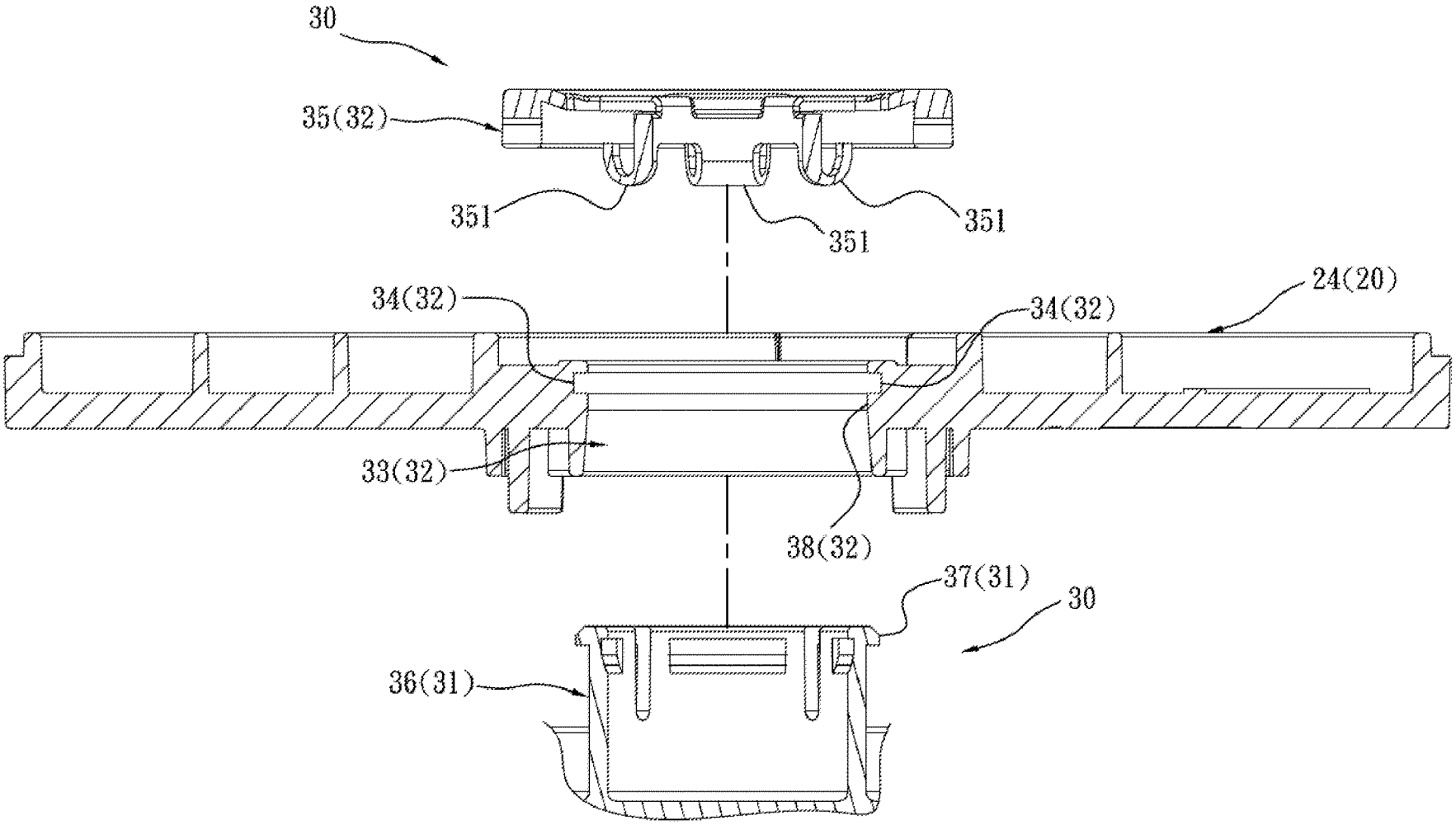
FIG. 5 is an exploded, side sectional view of a packing member, a shaft tube, and a sleeve of a second embodiment according to the present invention.

Moreover, the second fastening portion 32 is further located at, but not limited to, the sliding block 24, as shown in FIG. 4 or the first fastening portion 31 is further located at, but not limited to, the sliding block 24 (not shown in figures). The diversity in design is expanded and the products manufactured are more competitive in the market.

Figure 6:
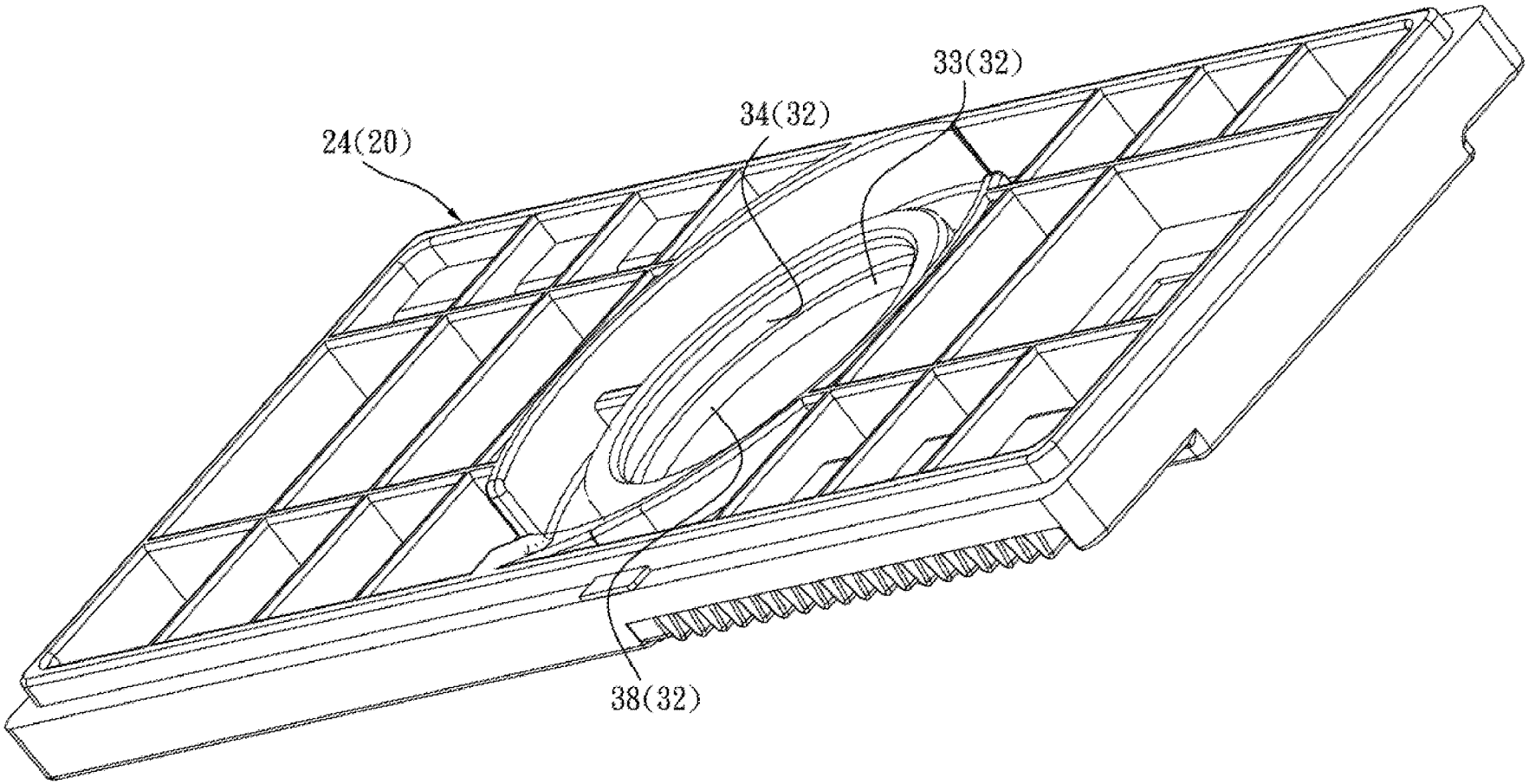
FIG. 6 is a perspective view of a sliding block of an embodiment according to the present invention.

Refer to FIG. 7-10, the sleeve 33 is communicating with the opening of the first mounting space 21 and the fourth fastening portion 34 of the sleeve 33 is located at an inner circular surface 38 inside the sleeve 33, but not limited, as shown in FIG. 6. The sleeve 33 further includes a packing member 35 (but not limited) which is mounted to the sliding block 24 and located above the sleeve 33, as shown in FIG. 7. The packing member 35 includes at least two packing pieces 351 which are claw-shaped and spaced apart circularly, as shown in FIG. 4. As shown in FIG. 7-10, the third fastening portion 37 of the sleeve 36 is formed on a top of the sleeve 36. While being assembled into the chair armrest 1, the third fastening portion 37 of the sleeve 36 is pressed by compressive force of the packing pieces 351 of the packing member 35 and forced to lock into the fourth fastening portion 34.

Refer to FIG. 8-10, the fourth fastening portion 34 is a locking groove 34*a* mounted to the inner circular surface 38 (as shown in FIG. 8), an insertion hole 34*b* located at the inner circular surface 38 (as shown in FIG. 9), or a distal-end surface 34*c* of the inner circular surface 38 (as shown in FIG. 10), but not limited. Such diversity in design makes present products more competitive in the market.

Refer to FIG. 3, the armrest base 23 is further including but not limited to a damper gear 26, but not limited while the sliding block 24 is also having but not limited to a rack 27 engaged with the damper gear 26. Thereby the armrest pad body 20 can be moved forward and backward relative to the armrest support 10 and the sliding block 24 with a damping effect for adjustment, as the arrow A in FIG. 1 and the arrow C in FIG. 13 indicate. The design increases product competitiveness in the market.

Compared with the chair armrest available now, the present chair armrest 1 has the following advantages: the armrest support 10 and the armrest pad body 20 are connected into one part by vertical fastening of the first fastening portion 31 and the second fastening portion 32 of the fastening member 30. Thus users (such as clients) only need to complete the assembly by simple fastening in the vertical direction, without using fasteners or tools. The design not only saves manufacturing cost but also addresses the issue of reduced structural strength and/or tightness of the chair armrest assembled by the users themselves efficiently. As shown FIG. 7, the top support surface 11 of the armrest support and the bottom surface of the armrest pad body 20 are closely attached to each other. Thus the hazardous situation for the clients in use no longer exists. Therefore, product competitiveness in the market is improved.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. An easily assembled chair armrest comprising:

an armrest support having a top support surface formed on a top thereof;

an armrest pad body disposed on the top support surface of the armrest support and having a first mounting space which is arranged at a bottom surface of the armrest pad body and provided with an opening facing downward; and at least one fastening member mounted between the armrest support and the armrest pad body and provided with at least one first fastening portion and at least one second fastening portion which are aligned and pressed to fit and connect with each other vertically; one of the first fastening portion and the second fastening portion is disposed on the top support surface while the other of the first fastening portion and the second fastening portion is arranged at the first mounting space and positions of the first fastening portion and the second fastening portion are corresponding to each other; the first fastening portion and the second fastening portion are respectively a shaft tube provided with a third fastening portion and a sleeve provided with a fourth fastening portion corresponding to the third fastening portion; the shaft tube and the sleeve are joined together by the third fastening portion fastened with the fourth fastening portion;

wherein the armrest support and the armrest pad body are assembled into one part by the first fastening portion and the second fastening portion of the fastening member fastened with each other vertically while being assembled into the chair armrest;

wherein the armrest pad body is composed of an armrest pad and an armrest member;

wherein the first mounting space is located at the armrest member;

wherein the armrest member includes an armrest cover and an armrest base and the opening of the first mounting space is arranged at the armrest base;

wherein a sliding block and a sliding slot are disposed in the armrest base of the armrest member and the sliding block is able to be moved forward and backward in the sliding slot of the armrest base; wherein the armrest pad body is able to be moved forward and backward relative to the armrest support and the sliding block for adjustment when the armrest support and the sliding block remain still;

wherein the sleeve is communicating with the opening of the first mounting space and the fourth fastening portion of the sleeve is located at an inner circular surface inside the sleeve; wherein the sleeve further includes a packing member which is mounted to the sliding block, located above the sleeve, and having at least two packing pieces; wherein the two packing pieces are claw-shaped and spaced apart circularly; wherein the third fastening portion of the sleeve is formed on a top of the sleeve; wherein the third fastening portion of the sleeve is pressed by compressive force of the packing pieces of the packing member and forced to lock into the fourth fastening portion while being assembled into the chair armrest.

2. The chair armrest as claimed in claim 1, wherein the first fastening portion is located at the top support surface of the armrest support; wherein the second fastening portion is located in the first mounting space.

3. The chair armrest as claimed in claim 1, wherein the first fastening portion is located in the first mounting space; wherein the second fastening portion is located at the top support surface of the armrest support.

4. The chair armrest as claimed in claim 1, wherein the second fastening portion is located at the sliding block.

5. The chair armrest as claimed in claim 1, wherein the first fastening portion is located at the sliding block.

6. The chair armrest as claimed in claim 1, wherein the fourth fastening portion is a locking groove mounted to the inner circular surface, an insertion hole located at the inner circular surface, or a distal-end surface of the inner circular surface.

* * * * *